US006228002B1

(12) United States Patent
Dantolan

(10) Patent No.: US 6,228,002 B1
(45) **Date of Patent: *May 8, 2001**

(54) ROTATABLE WEIGHT EXERCISE DEVICE

(76) Inventor: Harry E. Dantolan, 11045 S. Spaulding, Chicago, IL (US) 60655

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/877,973

(22) Filed: Jun. 18, 1997

(51) Int. Cl.[7] ..... A63B 21/06
(52) U.S. Cl. ..... 482/93; 482/109; 482/110
(58) Field of Search ..... 482/93, 109, 110, 482/44–46; 473/242, 256

(56) References Cited

U.S. PATENT DOCUMENTS

| | | | | |
|---|---|---|---|---|
| 647,220 | | 4/1900 | Courtney . | |
| 818,242 | | 4/1906 | Geisel . | |
| 1,956,498 | | 4/1934 | Duke . | |
| 2,528,213 | | 10/1950 | Dantolan . | |
| 2,714,008 | | 7/1955 | Urban . | |
| 2,719,038 | * | 9/1955 | Massa | 482/109 |
| 2,920,418 | | 1/1960 | Britt . | |
| 3,544,106 | | 12/1970 | Barrett . | |
| 3,545,121 | | 12/1970 | Misko . | |
| 3,756,597 | * | 9/1973 | Monti | 482/110 |
| 3,761,083 | | 9/1973 | Buchner . | |
| 3,938,803 | | 2/1976 | Wilmoth et al. . | |
| 4,602,788 | * | 7/1986 | Wendt | 482/109 |
| 4,623,146 | | 11/1986 | Jackson . | |
| 4,775,149 | | 10/1988 | Wilson . | |
| 4,787,623 | * | 11/1988 | Cedar | 482/110 |
| 4,809,975 | | 3/1989 | Lee . | |
| 5,121,925 | * | 6/1992 | Blundo | 482/110 |
| 5,209,481 | * | 5/1993 | DeBack | 473/256 |
| 5,334,118 | | 8/1994 | Dantolan . | |
| 5,474,511 | | 12/1995 | Dantolan . | |

FOREIGN PATENT DOCUMENTS

| | | |
|---|---|---|
| 161282 | 4/1921 | (GB) . |

OTHER PUBLICATIONS

The Indian Club Exercise, Sam D. Kehoe, 1866.

* cited by examiner

*Primary Examiner*—John Mulcahy
(74) *Attorney, Agent, or Firm*—Brinks Hofer Gilson & Lione

(57) ABSTRACT

A rigid hollow tube has a hand grip on its upper end and a rotatable weight on its lower end. In use, the device is moved in an arcing up and down motion. The arcing motion forces the rotatable weight to rotate, assisting and intensifying the user's natural motion.

3 Claims, 1 Drawing Sheet

ROTATABLE WEIGHT EXERCISE DEVICE

FIELD OF THE INVENTION

The invention is related to barbell-type exercise devices and is particularly directed to an exercise device having a rotatable weight.

BACKGROUND OF THE INVENTION

The present invention is an advance in the art of exercise devices and is an improvement in the type of exercise device known in the art as "Indian Clubs." The Indian Club and similar exercise equipment typically consists of a tube or bar having a handle on one end and a weight on the other end. The handle makes the exercise device easy to pick up and maneuver. The length of the handle also determines the amount of leverage the user will have with respect to lifting and exercising with the weight.

Many advances have been made over the years with respect to weight training and exercise devices. Techniques prevalent today focus a great deal on what are known in the art as assisted and resistive training. Assisted training devices aid in primarily increasing the efficiency and speed in performing a particular exercise while maintaining proper technique with respect to the body part being exercised. Resistive devices focus primarily on increasing strength with respect to the particular body part being exercised.

One device well known in the art for performing assisted and resistive exercises is the "bungy cord." The bungy cord is a flexible, plastic cord which may be used in a number of ways, depending on the type of exercise. For running, the cord, via an attachment, is placed around the user's waist and used to either assist or resist the user. In the assist mode, which is more relevant to the present invention, the cord is set to a particular tension level and used to pull the user forward. If enough tension is applied, the cord will force the user to practice at faster speeds than the user is accustomed. When the cord is taken off, the user will run more efficiently, and hopefully faster, than before.

The present invention similarly applies assisted training principles but with respect to weight training exercises. Particularly, the present invention helps the user by assisting the natural motion of the arms and wrists during particular exercises.

The invention comprises a hollow metal tube with a hand grip on its upper end and a rotatable weight on its lower end. The weight, which is hollowed in the center, is swaged and secured on the tube. To use the invention one holds the hand grip and moves the weight in any combination of up and down or sideways motions. The invention enables one to exercise various portions of the body, including the arms, shoulders, back and abdomen.

SUMMARY OF THE INVENTION

A particular feature of this invention is to provide an easy to use exercise device with a handle on its upper end and a rotatable weight on its lower end, the rotatable weight serving to assist in the natural and full range of the user's motion.

According to the invention a tube is provided with a hand grip at its upper end and with a rotatable weight at its lower end. The rotatable weight rotates when said exercise device is moved in an arcing fashion.

A further feature of the invention is to provide a method of making an exercise device comprising the steps of providing a tube, sliding a hand grip over the upper end of the tube, sliding a weight, said weight having a hollowed center, over the lower end of the tube and swaging the lower end of the tube such that the weight is secured and free to rotate about the tube.

To aid in understanding the invention, one is directed towards the drawings and the detailed description of the present preferred embodiment of the invention.

DETAILED DESCRIPTION OF THE INVENTION

Figure 1:
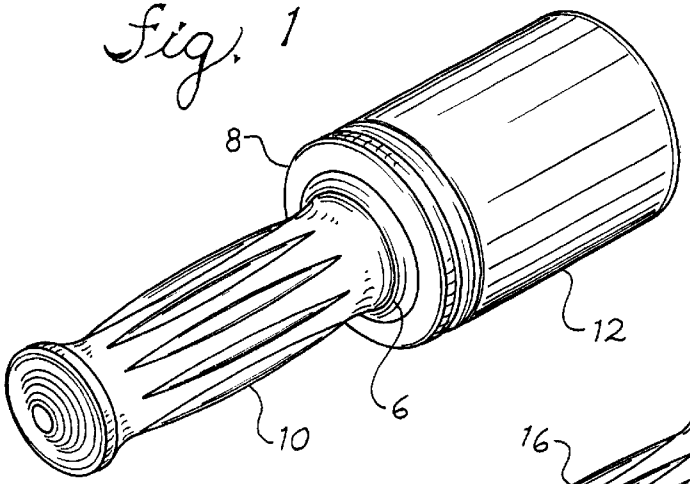
FIG. 1 is an illustration of an exercise device of the present invention.

An embodiment of a structure made in accordance with the present invention is the exercise device 8 illustrated in FIG. 1. Concerning the device 8, a rigid hollow tube has a hand grip 10 on its upper end and a rotatable weight 12 on its lower end. The hollow tube can be made of steel, iron, aluminum or other materials of similar strength. A solid or partially solid tube may be used without varying from the scope of the present invention. The hand grip 10 slides on to the upper end of the hollow tube. The hand grip 10 has a flange 6 and can either be a vinyl handle, or be made of rubber or some other material which is easy to grasp and hold onto.

In the preferred embodiment, the weight 12 is a hollow steel tube which may typically consist of rounded steel with a hole in the center. The weight 12 has an outside diameter of approximately 2¼ inches and a ¾ inch hole. A solid metal weight may be used but would require machining to generate the necessary hole.

The weight 12 slides over the lower end of the tubing just far enough such that it substantially covers the lower part of the tubing but does not come in contact with the hand grip 10. Prior to placing the hand grip 10 over the tubing, the lower end of the tube is expanded or swaged as is known in the art. The swaging of the hollow tube is accomplished using an arbor or drill rod which has a cone-shaped nose that guides the arbor into the hollow tube. The arbor is connected to a two-stroke hydraulic cylinder being of a type well known in the art with sufficient power to force the arbor into and out of the hollow tube. In the preferred embodiment, the hydraulic cylinder delivers a power-in force of 24,000 pounds and a power-out force of 22,000 pounds. The nose of the arbor has a diameter of approximately ⅝ of an inch and is used to precisely guide the remainder of the arbor into the hollow tube. The remaining portion of the arbor has a diameter of approximately ¾ of an inch. The hollow tube, before the swaging process, has an outside diameter of approximately ¾ of an inch and an interior diameter of approximately 5/8 of an inch. After swaging is completed, the hollow tube's outside diameter is approximately ⅞ of an inch, providing a secure swage between the hollow tube and the weight 12. The amount of swaging of the hollow tube will vary depending on the length of the arbor and the force of the cylinder stroke.

The expansion or swaging of the lower end of the tube increases the circumference of the lower end of the tube. The lower end of the tube is swaged just enough to secure the weight 12 on the tube but not so much as to prevent the weight 12 from rotating in either direction about the tube. Vinyl covering may be placed over the weight primarily for aesthetic purposes.

To use the device 8 one grasps the hand grip 10 with one hand and moves the device 8 in an arcing up and down motion along either the right or left side of the body depending on which hand is holding the device 8. Performed properly, the arcing motion will be accompanied by a rotation of the user's wrist, which in turn will rotate the weight 12. The weight 12 will rotate in the same direction as the wrist.

Figure 2B:
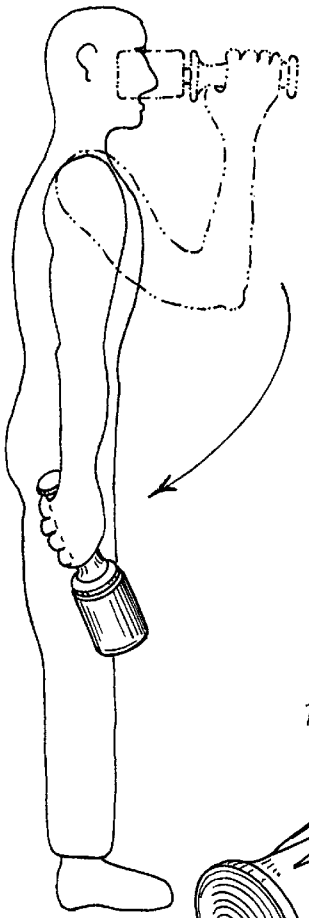
FIGS. 2A and 2B are illustrations of an exercise for which the exercise device of the present invention is intended.
Figure 2A:
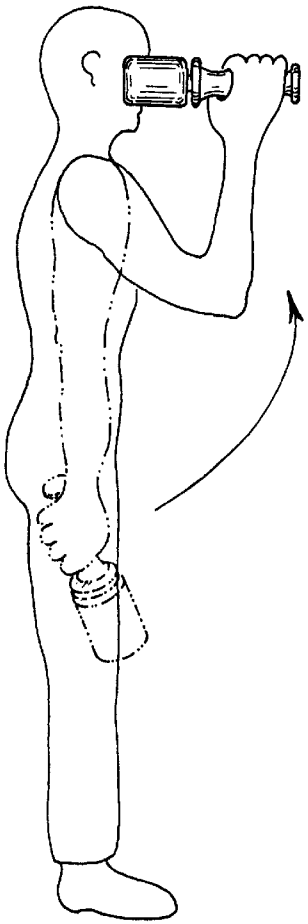

Referring to FIG. 2A, the user may start with the device in one hand in a downward position alongside the body. The user then lifts and curls the arm of the hand holding the device 8 in an arcing motion until the device 8 reaches ear level. FIG. 2B shows the opposite downward motion where the arm 8 of the hand holding the device 8 is subsequently lifted such that the device 8 is originally at ear level and then curled downward, in an arcing fashion, until the device 8 is alongside the body.

The primary purpose of the rotatable weight 12 is to assist the natural motion of the user. When either lifting the device or dropping the device downward as in FIGS. 2A and 2B, respectively, the forearm and wrist of the user will tend to rotate slightly. This natural rotation of the forearm and wrist is assisted by the rotation of the weight 12. While the rotation of the weight is slight, and is intended to be so, the cumulative affect of the weight's 12 rotation greatly increases the intensity of the exercise. Because the rotation of the weight assists the natural motion of the forearm and wrist, the risk of injury is lessened. The efficiency of the exercise is thereby greatly enhanced.

Figure 3:
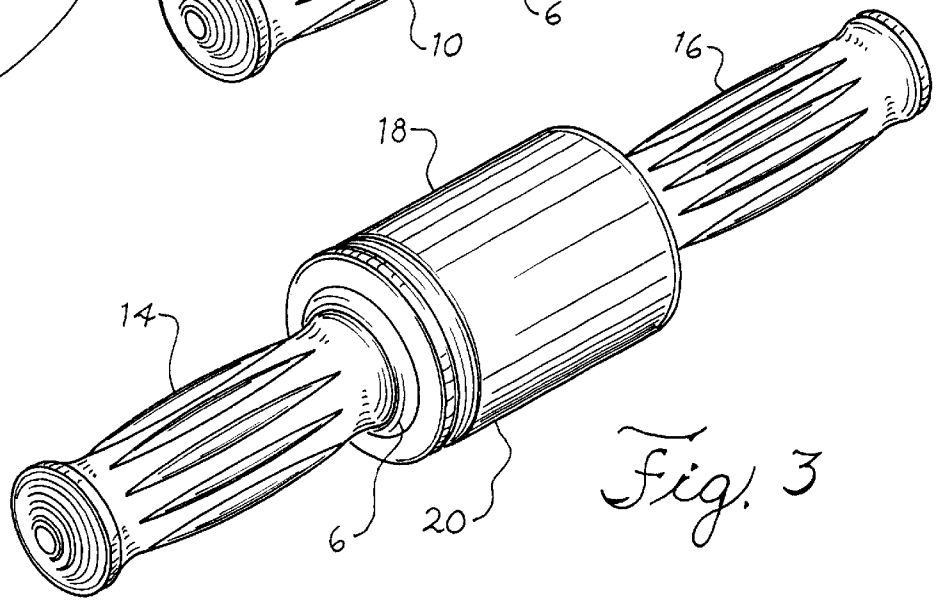
FIG. 3 is an illustration of another embodiment of the exercise device of the present invention.

Another embodiment of the present invention is illustrated in FIG. 3. In that embodiment, a hand grip 14 and a hand grip 16 are provided on the ends of a hollow tube with a rotatable weight 18 placed between the hand grips. This embodiment will allow a user to pick up the device 20 with one hand, perform the upward and downward exercise motions as described above, and easily switch the device 20 to the other hand so that the exercises may be repeated with that hand. The two handed embodiment shown in FIG. 3 also allows the user to pick the device 20 up with two hands. This is especially useful for persons having limited weight lifting ability, such as the elderly.

Many variations of the invention suggest themselves to those skilled in the art in view of the above disclosure without departing from the spirit and scope of this invention.

What is claimed is:

1. An exercise device comprising:

a straight shaft having upper and lower ends;

a single grip handle fixed concentrically about the shaft, the handle extending from the upper end of the shaft toward the lower end of the shaft;

a weight having an upper end and a lower end, the weight comprising a circular cylinder having a central longitudinal opening extending through the weight from the upper end to the lower end thereof, the lower end of the shaft extending through the opening in the weight;

a flange on the lower end of the single grip handle, the flange abutting the upper end of the weight; and means at the lower end of the shaft for securing the weight on the shaft such that the weight freely rotates about the shaft and sliding movement of the weight along the shaft is prevented.

2. The exercise device of claim 1, wherein the shaft is a rod.

3. The exercise device of claim 1, wherein the shaft is a tube.

* * * * *